US005879463A

United States Patent [19]

Proenca, Hilst

[11] Patent Number: 5,879,463

[45] Date of Patent: Mar. 9, 1999

[54] PROCESS FOR RAPID ACID HYDROLYSIS OF LIGNOCELLULOSIC MATERIAL AND HYDROLYSIS REACTOR

[75] Inventor: Antonio Geraldo Proenca, Hilst, Piraoicaba, Brazil

[73] Assignee: Dedini S/A.Administracao e Participacoes, Piracicaba, Brazil

[21] Appl. No.: 952,709

[22] PCT Filed: Mar. 5, 1997

[86] PCT No.: PCT/BR97/00007

§ 371 Date: Nov. 10, 1997

§ 102(e) Date: Nov. 10, 1997

[87] PCT Pub. No.: WO97/33035

PCT Pub. Date: Sep. 12, 1997

[30] Foreign Application Priority Data

Mar. 8, 1996 [BR] Brazil ..... 9600672

[51] Int. Cl.[6] ..... C13K 1/04

[52] U.S. Cl. ..... 127/37; 127/1

[58] Field of Search ..... 127/1, 37

[56] References Cited

U.S. PATENT DOCUMENTS

| | | | |
|---|---|---|---|
| 4,025,356 | 5/1977 | Nyman et al. | 127/37 |
| 4,470,851 | 9/1984 | Paszner et al. | 127/37 |
| 4,941,944 | 7/1990 | Chang | 162/19 |

FOREIGN PATENT DOCUMENTS

| | | | |
|---|---|---|---|
| 2472016 | 6/1981 | France | 127/37 |
| 222631 | 5/1985 | German Dem. Rep. | 127/37 |

*Primary Examiner*—David Brunsman
*Attorney, Agent, or Firm*—Abelman, Frayne & Schwab

[57] ABSTRACT

The present invention relates to a continuous process for acid hydrolysis of lignocellulosic material through which the delignification and saccharification operations are carried out in a single reaction cycle utilizing a solubilizing organic solvent of lignin and a strong and extremely diluted inorganic acid, and obtaining highly concentrated recoveries of sugar. For the execution of the present process a hydrolysis reactor is further presented.

20 Claims, 2 Drawing Sheets

PROCESS FOR RAPID ACID HYDROLYSIS OF LIGNOCELLULOSIC MATERIAL AND HYDROLYSIS REACTOR

FIELD OF THE INVENTION

The present invention relates to a process for acid hydrolysis of lignocellulosic material, such as wood, sugar cane bagasse, straw, vegetables, etc., for the obtention of sugars and lignin, among other products, as well as to a reactor for carrying out the referenced process.

BACKGROUND OF THE INVENTION

For the effect of hydrolysis, the lignocellulosic materials may be described as a celullosic, hemicellulose and lignin complex further containing lower organic components, such as taninnes, waxes, oils, etc, said "extractive" and mineral substances (silica, calcium, potassium, sodium, etc, the ashes). The cellulose (or glicane, 36 to 40% in mass) is a glucose polymer found in the amorphous form (its greater part) and in the microcrystalline form. The hemicellulose (34%) is a complex amorphous polymer containing glicane (–8%), xylane (22%), arabinane and galactane (total 4%). It has been shown that hemicellulose hydrolyzes almost instantly, microcrystalline cellulose is quite resistant to acid attacks and that amorphous cellulose is intermediary. The lignin (a polymer derived from phenyl propene containing active phenolitic functions) is not soluble in an exclusive acid medium, but may be dissolved by certain organic solvents. The ashes constitute of silica and aluminum and iron oxides that are very little soluble in hydrolytic means, and of potassium, sodium oxides, etc., that are soluble in acids. Such characteristics require desirable conditions for the hydrolysis apparatus and processes.

Acid hydrolysis processes of lignocellulosic materials produce, among others: hexoses (sugars with 6 carbons), such as glucose, galactose and mannose; pentoses (sugars with 5 carbons), such as xylose and arabinose: lignin; furfural; 5-hydromethil furfural; acetic acid; and methanol among others, in variable proportions, depending on the raw material being processed. Known acid hydrolysis processes of lignocellulosic materials are divided into two major groups: processes using concentrated acids and processes utilizing dilute acids.

From the first group, the "Bergius" and "Udic Rheinau" processes stand out, which use 40–45% hydrochloric acid, and the "Riga" process, which uses 75% sulfuric acid.

Although such processes present elevated hydrolysis yields (approximately 94% of the estoichiometrical value), high investments in equipment are required once they should be constructed with material resistant to such strongly concentrated acids. In addition, the manipulation of said acids makes the operation of the process extremely difficult.

Among processes which use dilute acids developed to overcome the drawbacks exposed hereinabove, the "Schoeller" process should be mentioned. According to this process the wood is heated in percolators at 134° C. with the aid of sulfuric acid, thus obtaining, through repeated extractions, sugars with concentration of 2 to 4% in the resulting hydrolysis solution.

It is evident that this process, which is carried out in a batch procedure, presents a yield that is rather below that commercially expected.

In order to improve the process with dilute acid described above, a process namely "Madison" has been developed by the Laboratory of Forest Products of the United States, which uses 0.6% dilute sulfuric acid within the range of 18 $m^3$ by ton of the dried treated material and is carried out in 3 to 5 hours, reaches a maximum yield of 67% of its estoichiometrical value. Although the "Madison" process is substantially improved relatively to the "Scholler" process, it presents a yield still below the desired. Further, due to the elevated temperature at which it is carried out, the equipment, even when dilute acid is used, must be made from special materials, such as titanium and zirconium, thus elevating the investment value therefor, even though below the investment made in processes wherein strong acids are used.

Apart from the drawbacks evidenced above, which are specific to each type of process, both present a common problem: during the saccharification operation of the acid hydrolysis process there is virtually no delignification, the lignin being retained in the equipment in a viscous state, from which it is taken in a batch process, thus creating the additional problem of managing the continuous step of saccharification and discontinuous step of withdrawing the lignin, consolidating them as a single process routine.

Endeavors carried out to obtain a continuous process for acid hydrolysis of lignocellulosic materials that would provide simultaneous delignification and saccharification have resulted in a continuous countercurrent process for the production of lignin and sugars from wood and other lignocellulosic materials through delignification and saccharification by organossolvent at elevated temperatures and pressures, such process basically comprising: continuous introduction, by a reactor end, of comminuted lignocellulosic material; countercurrent introduction, by another end of the reactor, of a cooking liquor comprising a larger quantity of organic solvent and a smaller quantity of water, and a slight quantity of inorganic acid; contact of said lignocellulosic material with said cooking liquor, and withdrawal of the latter after being mixed with and having dissolved sugars and the remaining substances of the comminuted lignocellulosic material.

Although such process achieves elevated degrees of lignin recovery and sugar conversion, such performance has not been quantitatively disclosed. Further, the execution of said process in laboratory scales have shown many possibilities of improvements: once greater delignification or saccharification occurs in a distinct manner at each level of the reactor, and considering that the process in question provides cooking liquor feeding and withdrawal of the product from the liquor under unique flows, the temperature and concentration conditions of the solvent and reagent along the reactor's height are practically aleatory, thus making it difficult and even impossible to adequately control the process in terms of obtention of the total conversion of the lignocellulosic material, without overage of the reacting acid, as well as with respect to the prevention of decomposition of sugars obtained from the hydrolysis of the cellulosic material.

DISCLOSURE OF THE INVENTION

Thus, it is an object of the present invention to provide a process for rapid acid hydrolysis of lignocellulosic material using a hydrossolvent system that allows the simultaneous delignification and saccharification of same, according to temperature and concentration parameters of the solvent and reagent that are precisely controlled in the several levels of the reactor, so as to obtain lignin dissolution and maximum conversions of sugars while substantially avoiding thermal decomposition of the formed sugars.

It is also an object of the present invention to provide a rapid acid hydrolysis reactor of the lignocellulosic material disclosed hereinabove.

The above and other objectives and advantages of the present invention are achieved by the provision of a process for rapid acid hydrolysis of lignocellulosic material, comprising a cellulosic portion and a lignin portion and comprising the steps of:

(a) continuously feeding by the top a pressurized reactor, with a uniform flow of lignocellulosic material preheated and comminuted to the size of a hydrolizably acceptable particle;

(b) contacting said lignocellulosic material in the different levels of the reactor, with a plurality of flows of a hydrossolvent system comprising a greater portion of a lignin solubilizing organic solvent and water, and a smaller portion of an extremely dilute solution of a strong inorganic acid so as to simultaneously react the cellulosic material and dissolve the lignin in the form of a hydrolysis extract comprising products of the cellulosic portion reaction and a lignin solution, and a solid phase comprising non-reacted and non-dissolved material;

(c) retaining said solid phase in such a way as to be deposited at the bottom of the reactor;

(d) recirculating a controlled flow of the liquid phase obtained with (b) at the different levels of the reactor, to a duly adjusted temperature, and incorporating said flow to a corresponding hidrossolvent flow so as to provide, in said levels of the reactor, temperatures and concentrations of organic solvent and strong inorganic acid that are adequate to react the cellulosic material and to dissolve the lignin present in the respective levels of the reactor;

(e) withdrawing from said levels of the reactor the remainder of said liquid phase, submitting it to an abrupt lowering of temperature at the exit of said reactor so as to avoid decomposition reactions of said reaction products of the cellulosic portion and obtaining, through evaporation of the solvent, a concentrate of the reaction products of the cellulosic portion and of the lignin;

(f) separating said lignin by decantation; and (g) transferring said concentrate of the reaction products of the cellulosic portion to the subsequent process steps.

In a second aspect, the present invention relates to a hydrolysis reactor for the execution of the process for rapid acid hydrolysis of lignocellulosic material described above, said hydrolysis reactor comprising a vertical tubular body incorporating, along its longitudinal extension, a plurality of hydrolysis extract captations; a lignocellulosic material feeding opening, continuously feeding lignocellulosic material to said reactor; a plurality of hydrossolvent feeding tubes, continuously feeding hydrossolvent to the reactor so as to provide an intimate contact between said hydrossolvent and lignocellulosic material within the latter; and a plurality of fluid circuits, each being fluidly connected to at least one hydrolysis extract captation so as to receive, through same, hydrolyzed extract from said reactor, and to selectively and controlledly refeed said extract to the latter and /or transfer it to the subsequent process step through a flow controlling means.

In practical terms, the process for acid hydrolysis of lignocellulosic material presents, among others, the following advantages: the use of extremely dilute acid, thereby not requiring equipment made from especial and very expensive materials; simultaneous execution of the delignification and saccharification steps, thus requiring a reduced quantity of equipment; and, the execution of said process under such conditions of temperature as to occur the least degradation of the sugars obtained. In view of the fact that the hydrolysis extract effluent from the reactor is partially recirculated, it is possible to provide a precise adjustment of the concentration and temperature of the reagents fed in each level of the reactor by simply adjusting the flow and temperature of the recirculate which, without reagents, works as diluent for a given feeding of a new reagent that is incorporated to the hydrossolvent. The abrupt cooling of the hydrolysis extract right at the reactor exit is a characteristic of the process that provides a rapid evaporation of the solvent, even almost spontaneous, thus freezing the afore mentioned degradation reactions of sugars. Further, the solvent evaporation of 15 to 30% in mass diminishes the load of the destination column consequently lowering its costs. Additionally, the referenced process reaches recovery levels of up to 85% and sugar concentrations of up to 35%, values which have never been achieved by known processes: in the present case, the concentration of sugars reached is seven times greater than those previously disclosed.

In another aspect, the process proposed herein is extremely rapid: while the shortest periods of time known for the acid hydrolysis of lignocellulosic materials range from 3 to 5 hours, the present processes is concluded between 10 and 40 minutes, thus providing an increase of 7 to 18 times in the productivity of the reactor and of its auxiliary equipment, expressed in tons of dried material processed by cubic meter and by the hour, and with a proportional reduction in the time of recovery of the unit investment.

The invention will be described relatively to the attached drawings as follows:

BEST MODE FOR CARRYING OUT THE INVENTION

Figure 1:
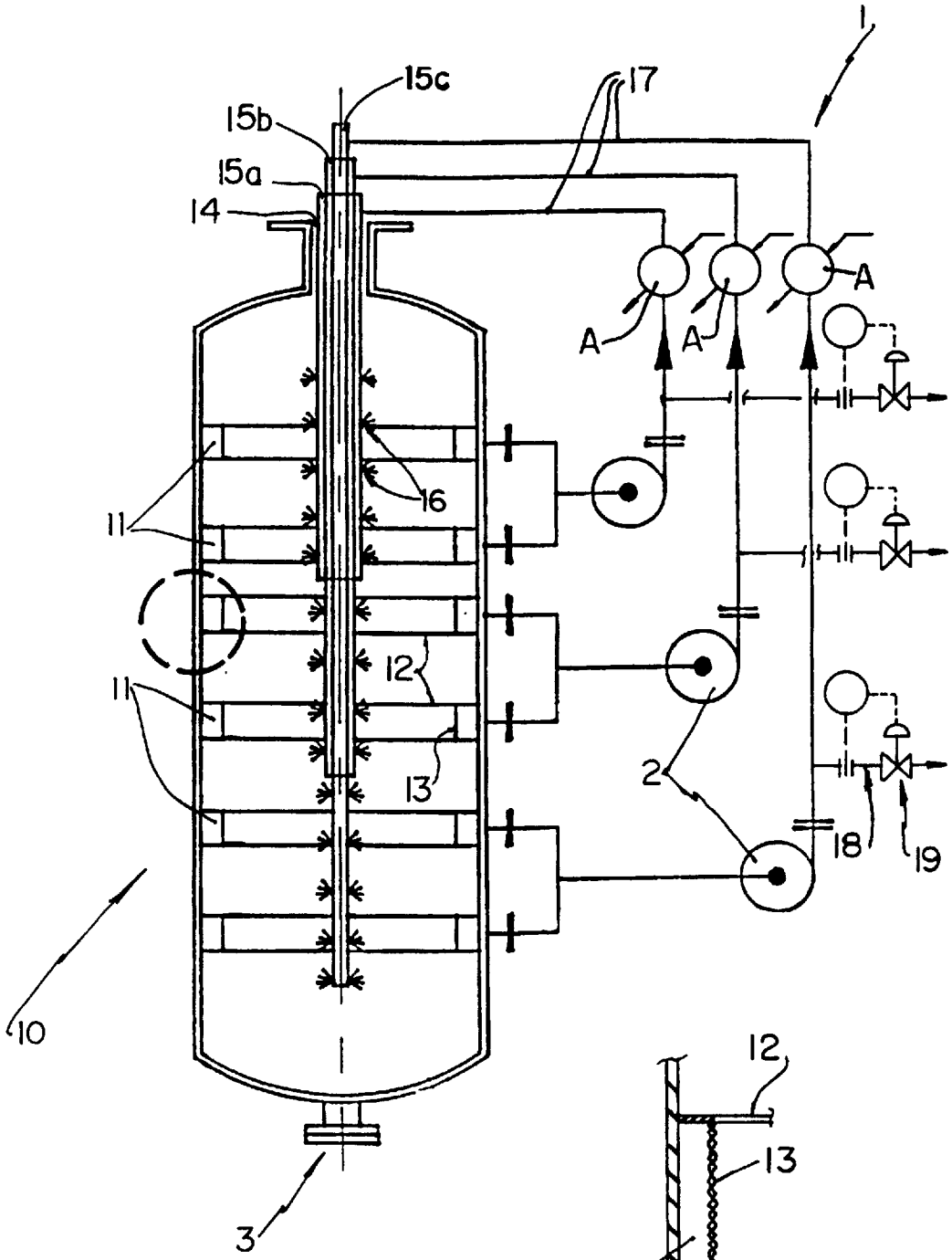
FIG. 1 represents a schematic vertical cross sectional view of a reactor developed for the execution of the proposed process for rapid hydrolysis.
Figure 2:
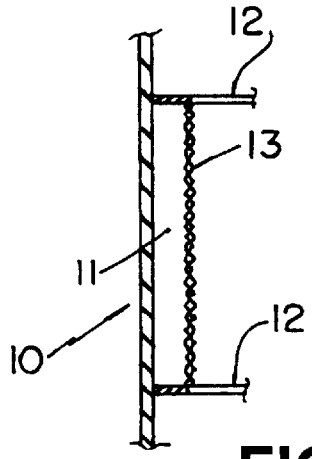
FIG. 2 represents an amplification of the construction of a hydrolysis extract captation of the reactor of the present invention, according to the detail encircled in FIG. 1.

Although the cellulosic component of the lignocellulosic material to be treated comprises a hemicellulosic portion itself, for the purpose of simplification of the disclosure to follow, the expression "cellulosic portion" will be used for making reference to both said portions, in its group.

The delignification and saccharification operations of the lignocellulosic material of the present process are carried out through a single step in a reactor 10, using a hydrossolvent system formulated in such a way as to simultaneously react the cellulosic portions and to dissolve the lignin portion which constitute said lignocellulosic material, thereby obtaining a liquid phase, or an extract, comprising hydrolysis products of said cellulosic portion, predominantly sugars, said solution being subsequently withdrawn, and a lignin solution, and a solid phase comprising non-reacted and non-dissolved matter, mainly mineral matter, which is deposited at the bottom of said reactor 10.

Once the proposed process is a continuous one, both the lignocellulosic and hydrossolvent feeding must be constant and uniform. As such, as well as to secure a satisfactory contact surface between said hydrossolvent and lignocellulosic material, and further to avoid obstructions of the material at the reactor inlet, the latter is comminuted until it reaches the size of a hydrolizably acceptable particle.

Next, the lignocellulosic material feeding is pre-heated to a temperature of 80° to 180° C., preferably up to 100° to 150° C., so as to soften the vegetal fiber, expel air bubbles occluded therein, thereby facilitating the penetration of the hydrossolvent and, consequently, the dissolution of the lignin within the reactor 10, liberating the cellulosic portion for a rapid and efficient acid attack.

In order to function as described above, the hydrossolvent system comprises: from 40 to 90% in volume, and preferably from 50 to 80% in volume of a lignin solubilizing organic solvent selected from the group consisting of carbon, cetones of 2 to 6 carbon atoms and mixtures thereof, preferably methanol, ethanol, acetone and the like, or mixtures of same, and more preferably acetone; from 10 to 60% in volume, and preferably from 20 to 50% in volume of water; and a strong inorganic acid selected from the group consisting of sulfuric acid, hydrochloric acid, phosphoric acid and the like, or mixtures thereof, and preferably sulfuric acid in such a quantity as to provide a concentration of 0,01N to 0,1N, and preferably from 0,02N to 0,05N of said acid in said hydrossolvent system.

The delignification and saccharification step of the lignocellulosic material is processed in a distinct manner in each level within the reactor 10. Different concentrations of reagent acid should be provided between the raw material and hydrossolvent and different temperatures of reaction should be provided in each level of the reactor, the adjustment of such parameters being carried out through a step that is a fundamental characteristic of the proposed process, whichever is the recirculation of a part of the hydrolysis extract effluent from the reactor 10 without the reacting acid: since new hydrossolvent is introduced at constant temperature and concentration, the simple adjustment of the temperature of the recirculated extract and of the flows thereof and of the new hydrossolvent will adequate the acid concentration to that strictly necessary in order to react with the cellulosic portion of the lignocellulosic feeding of reactor 10.

In general terms, the delignification and saccharification step is carried out within the reactor 1 at a temperature of 160° to 250° C., and preferably from 180° to 190° C., advantageously under pressure of 20 to 40 bar, and preferably from 20 to 30 bar. The hydrossolvent and lignocellulosic material feeding are evenly distributed, according to the hydrossolvent radial currents in a proportion of 2 to 18, and preferably from 3 to $10M^3$ of hydrossolvent by ton of the hydrocellulosic material to be treated. Under such conditions, both currents intimately contact one another, obtaining the afore mentioned liquid and solid phases. In order to prevent that greater degradations of the formed sugars occur, said liquid phase, or extract, is immediately transferred to a rapid solvent evaporator ("flash evaporator"), suffering an abrupt decrease in temperature.

The extract obtained in the delignification and saccharification step, duly cooled down, and preferably filtered off, is transferred to a destillation column in which it is concentrated, by extracting a greater quantity of solvent, which is recycled to the process. The concentrated extract thus obtained is received in a first decanter, in which it separates in a lower layer comprising lignin and an upper layer defining a concentrate or liquor comprising sugars, with an assay of up to 35% by weight, depending on the starting lignocellulosic material, and the remaining products resulting from the saccharification reaction, and a lignin deposit, insolubilized by the withdrawal of the solvent.

Figure 3:
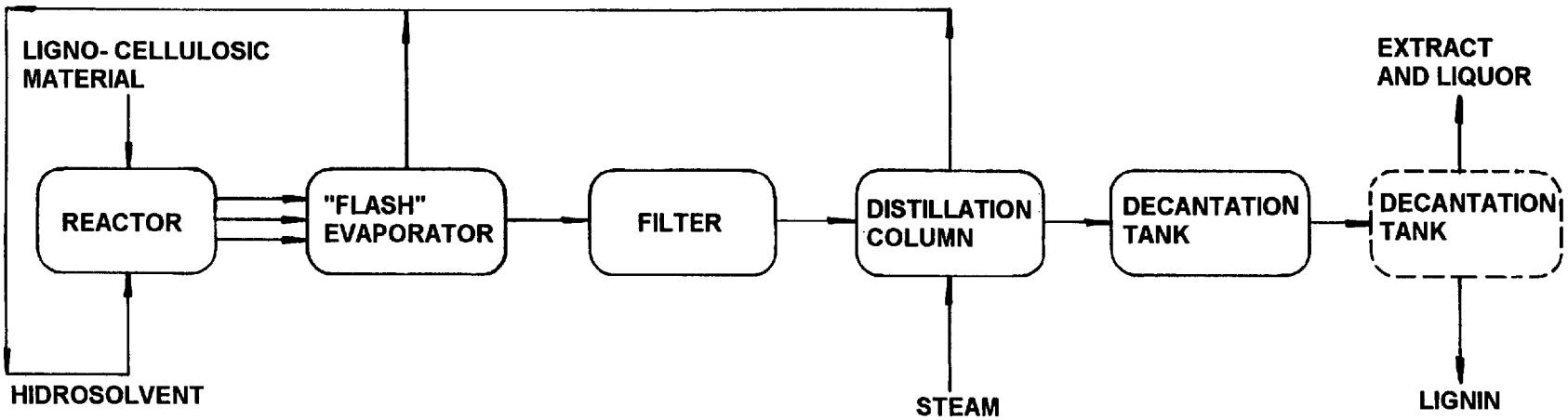
FIG. 3 represents a flow chart of the process of the present invention.

In a second construction, the concentrated and decanted extract may be submitted to a second decanter, traced in a dotted line in FIG. 3.

The decanted lignin is recovered, at least partially dried, and may be used in several applications, from fuel, in view of its calorific lower power (PCI) of 24,4 MJ/KG and to the low ash (0,30%) and sulfur (0,14%) essays, even as raw material for the manufacture of phenolic resins (substituting the phenol), due to its high reactivity.

The liquor is submitted to subsequent operations for the recovery of the remaining products.

In the steps prior to the concentration of the liquid phase, it is very important that the extraction operation of the solvent be adjusted in such a way as to charge the lignin to the destination step, thus avoiding its incrustation in the equipment as it normally occurs in the majority of the known processes. Although the present invention may be carried out in conventional equipment, eventually submitted to slight modifications and presenting yield levels above those already known in the art, the best results have been achieved with reactor 10, specially developed for the execution of the present process.

According to FIG. 1, the hydrolysis reactor 10 comprises a vertical cylindrical tubular body constituted of an adequate metallic material, such as stainless steel, internally incorporating in the corresponding levels of said reactor 10 a plurality of preferably six hydrolysis extract captations 11, each being defined by: two filter support rings 12, preferably constituted of the same material as that of said reactor 10, and incorporated, such as by welding, to the internal wall thereof, said rings 12 being substantially parallel and spacedly disposed to the internal edges thereof, a cylindrical filtrating screen 13 constituted of an adequate material, such as stainless steel, being fixed, such as by screwing, and further presenting mesh Tyler between 16 and 200, preferably mesh Tyler 100; and, an orifice, which is not illustrated, provided on the wall of the reactor 10, radially disposed relatively to said filtrating screen 13, and providing fluid contact between the interior and the exterior of said reactor 10.

Preferably, the reactor 10 is fed by the top with lignocellulosic material through a feeding lignocellulosic material opening 14, and with hydrossolvent through a plurality, and preferably, three hydrossolvent feeding tubes 15*a*, 15*b*, 15*c*, concentric and internal to the latter, of increasing length from the outside towards the inside, and closed in its free ends, each being provided with a plurality of lateral spraying orifices 16, so as to radially spray hydrossolvent against the lignocellulosic material inside said reactor 10, providing an intimate contact between one another.

Externally, each two adjacent hydrolysis extract captations 11 are fluidly linked, parallel to one another, through the respective orifices in reactor 10, to a corresponding fluid circuit 1, the latter including a circulation pump 2, downstream from which said fluid circuit 1 branches, defining a reactor refeeding tube 17 and a reactor outlet tube 18, the flows through both being selectively controllable through an adequate flow controlling means, such as valve 19, provided in tube 18.

The hydrolysis reactor 10, as described above, operates flooded, the liquid medium flooding it at least until the upper captation 11 is covered, such level being constant once, being the process continuous, the total lignocellulosic and hydrossolvent feeding that enter the reactor 10 is substantially identical to the volume of the product withdrawn through the outlet tube 18. According to the construction disclosed above, the reactor 10 must be initially flooded, the hydrossolvent being fed thereto until the desired level is achieved. Subsequently, the process is initiated by feeding the lignocellulosic material and hydrossolvent to the reactor 10, through the feeding opening 14 and through the feeding tubes 15*a*, 15*b* and 15*c*, respectively.

As the lignocellulosic material goes down within the reactor 10, through hydrossolvent wash, while it is sprayed by the latter through the spraying orifices 16, it is gradually consumed, the cellulosic portion being hydrolyzed so as to form sugars, while the lignin is dissolved, the resulting liquid blend defining a hydrolysis extract which is pumped out of the reactor 10 through the several captations 11. Each fluid circuit 1 receives, this way, a filtered hydrolysis extract flow, in other words, substantially isempt of solid material once the latter, comprising semi-attacked raw material, is retained by the filtrating screen 13, from which it detaches due to the agitation provoked by the hydrossolvent liquor current, returning to the reaction medium. The mineral matter constituent of the vegetable separates as the latter is dissolved, being deposited at the bottom of reactor 10. As mentioned above, the hydrolysis extract obtained in a specific level of the reactor 10 is pumped through the corresponding fluid circuit 1, a part of which is recirculated through the reactor corresponding refeeding tube 17, and is incorporated to the hydrossolvent feeding in a respective hydrossolvent feeding tube 15*a*, 15*b*, 15*c*. As such, the hydrolysis extract without reacting acid dilutes the new hydrossolvent, adjusting its acid concentration to that strictly necessary to react with the cellulosic portion of the raw material feeding in that level of the reactor 10.

The thermal control of the process within the hydrolysis reactor 10 is also effected through the recirculation hydrolysis extract flow. As such, the reactor feeding tubes 17 are provided with adequate heating means A, such as steam shirts, each controlledly heating the extract flow of the corresponding reactor feeding tube 17, in such a way as to provide, at the exit of the respective hydrossolvent feeding tube 15*a*, 15*b*, 15*c*, the desired process temperature required in that level of reactor 10.

The other non-circulated part of the hydrolysis extract is withdrawn through the corresponding outlet tube 18, in order to be subjected to an abrupt decrease of temperature and consequent concentration by evaporation of the solvent, the hydrolysis extract thus concentrated being led to the subsequent processing.

In the configuration illustrated and described above, the reactor 10 presents six captations 11, each two adjacent of which being fluidly connected in parallel, each through a corresponding orifice provided in said reactor 10, to a respective circuit 1, the latter being fluidly connected to a corresponding hydrossolvent feeding tube 15*a*, 15*b*, 15*c*.

Such a construction is preferred once it conciliates low manufacture and installation costs with a high operational performance, inasmuch as the processing of the lignocellulosic raw material generally utilized is concerned, and due to the specifications generally accepted for the final products.

However, due to the specific requirements on the raw material or the final product, the hydrolysis reactor may present several modifications, such as:

presenting a lower or greater number of hydrolysis extract captations;

each hydrolysis extract captation may be provided with a plurality of reactor outlet orifices, the latter being connected to a fluid circuit by means of a corresponding collector;

the upper filter support ring of each hydrolysis extract captation may present a bigger diameter so that the corresponding filtrating screen be inclined downwardly, thereby facilitating the silica precipitation;

each hydrolysis extract captation may be connected to an individual fluid circuit, hydrossolvent feeding tubes and individual reactor outlet tubes being thus provided; and each fluid circuit may be connected to three or more hydrolysis extract captations.

In order to allow sporadic withdrawal of the silica deposited at the bottom of the reactor 10, the latter is provided therein with a drain opening 3.

Although the hydrolysis reactor 10 for the process proposed herein may be made of, i.e., stainless steel 316 L, when using extremely dilute sulfuric acid, if it is desired, the constructive material may be carbon steel, covered with a protection metal, such as niobium, titanium or zirconium.

In order to provide a better view of the proposed hydrolysis process, FIG. 3 represents a flow chart containing a possible processing sequence.

I claim:

1. A process for rapid acid hydrolysis of lignocellulosic material comprising a cellulosic portion and a lignin portion, characterized in that it comprises the steps of:

(a) continuously feeding by the top a pressurized reactor (10), with a uniform flow of lignocellulosic material pre-heated and comminuted to the size of a hydrolizibly acceptable particle;

(b) contacting said lignocellulosic material in the different levels of the reactor (10), with a plurality of flows of a hydrossolvent system comprising a greater portion of a lignin solubilizing organic solvent, and water, and a smaller portion of an extremely dilute solution of a strong inorganic acid, so as to simultaneously react the cellulosic material and dissolve the lignin, obtaining a liquid phase in the form of a hydrolysis extract comprising products of the reaction of the cellulosic portion and a lignin solution, and a solid phase comprising non-reacted and non-dissolved material;

(c) retaining said solid phase in such a way as to be deposited at the bottom of said reactor (10);

(d) recirculating a controlled flow of the liquid phase obtained in (b), at the different levels of the reactor (10), to a duly adjusted temperature, and incorporating said flow to a corresponding hydrossolvent flow so as to provide in said levels of the reactor temperatures and concentrations of organic solvent and adequate strong inorganic acid to react cellulosic material and to dissolve the lignin present in the respective levels of the reactor;

(e) withdrawing from said levels of the reactor (10) the remainder of said liquid phase submitting it, at the exit of said reactor (10), to an abrupt lowering of temperature in such a way as to avoid decomposition reactions of said reaction products of the cellulosic portion and obtaining, by evaporation of the solvent, a concentrate of the reaction product of the cellulosic portion and of the lignin;

(f) transferring said lignin by decantation; and, (g) transferring said concentrate of the reaction products of the cellulosic portion to the subsequent processing steps.

2. The process of claim 1, characterized in that the remainder of the liquid phase is withdrawn from the circulation flow of said liquid phase.

3. The process of claim 1, characterized in that the hydrossolvent system incorporated to the recirculation flow of the liquid phase is contacted with the lignocellulosic material in accordance with radial flows.

4. The process of claim 1, characterized in that the adequate temperature in the various levels of the reactor (10) is obtained by heating the corresponding recirculation flow of the liquid phase.

5. The process of claim 1, characterized in that the hydrossolvent system comprises: from 40 to 90% in volume of an organic solvent selected from the group consisting of alcohols with 1 to 4 carbon atoms, ketones from 2 to 6 carbon atoms and the like, or mixtures thereof; from 10 to 60% in volume of water; and, a strong acid selected from the group consisting of sulfuric acid, hydrochloric acid, phosphoric acid and the like, or mixtures thereof, in such a quantity as to provide a concentration from 0.01N to 0.1N of said acid in said hydrossolvent system.

6. The process of claim 1, characterized in that the hydrossolvent system comprises: from 50 to 80% in volume of an organic solvent selected from the group consisting of methanol, ethanol, acetone and the like, or mixtures thereof; from 20 to 50% in volume of water; and sulfuric acid in such a quantity as to provide a concentration from 0.01N to 0.05N of said acid in said hydrossolvent.

7. The process of claim 1, characterized in that the organic acid comprises acetone.

8. The process of claim 1, characterized in that the pressure of the reactor (10) is from 20 to 40 bar.

9. The process of claim 1, characterized in that the pressure of the reactor (10) is from 20 to 30 bar.

10. The process of claim 1, characterized in that the lignocellulosic material is pre-heated at a temperature from 80° to 180° C.

11. The process of claim 1, characterized in that the feeding of the lignocellulosic material is pre-heated at a temperature ranging from 100° to 150° C.

12. The process of claim 1, characterized in that the temperatures in the several levels of the reactor (10) are from 160° to 250° C.

13. The process of claim 1, characterized in that the temperatures in the several levels of the reactor (10) are from 180° to 190° C.

14. A hydrolysis reactor for executing the delignification and saccharification step defined in claim 1, characterized in that it comprises a vertical tubular body (10), incorporating along its longitudinal extension a plurality of hydrolysis extract captations (11); a lignocellulosic material feeding opening (14), continuously feeding lignocellulosic material to said reactor (10), in such a way as to provide an intimate contact between said hydrossolvent and lignocellulosic material, within the latter; and a plurality of fluid circuits (1), each being fluidly connected to at least one captation of hydrolysis extract (11), in such a way as to receive, therethrough, hydrolyzed extract from said reactor (10), and selectively and controlledly refeed said extract to the latter and/or transfer it to the subsequent process step, through a flow controlling means (19).

15. The reactor of claim 14, characterized in that each hydrolysis extract captation (11) comprises: two filter support rings (12), substantially horizontal, parallel and spacedly fixed to the internal wall of the reactor (10) and bearing, fixed to the internal edges thereof, a cylindrical filtrating screen (13) of mesh Tyler between 16 and 200; and an orifice provided on the wall of said reactor (10), radially positioned relatively to said filtrating screen (13), thereby providing a fluid communication between the interior of the reactor (10) and the respective fluid circuit (1).

16. The reactor of claim 15, characterized in that the filtrating screen (13) presents Mesh 100.

17. The reactor of claim 15, characterized in that the lignocellulosic material feeding opening (14) is provided at the top of the reactor (10), said hydrossolvent feeding tubes (15*a*, 15*b*, 15*c*) being concentric and internal to the latter, of growing lengths from the outside to the inside, and closed in the ends thereof, each being provided with a plurality of lateral spraying orifices (16), providing an intimate contact between said lignocellulosic and hydrossolvent materials, by means of radial spraying of same against the former.

18. The reactor of claim 15, characterized in that the fluid circuit (1) is connected to two adjacent hydrolysis extract captations (11), receiving therefrom corresponding hydrolysis extract flows, said fluid circuit (1) including a circulation pump (2) which displaces said hydrolysis extract, downstream from said pump (2), said fluid circuit (1) branches, thus defining: a reactor refeeding tube (17), refeeding extract to said reactor through the corresponding hydrossolvent refeeding tube (15*a*, 15*b*, 15*c*); and a reactor outlet tube (19), conducting extract to said reactor (10) to the next process step; the flows through said recirculation (17) and exit (18) tubes being selectively controlled by a valve (19) mounted on the latter.

19. The reactor of claim 18, characterized in that each refeeding tube (17) of the reactor is provided with a corresponding heating means (A), controlledly heating the recirculating hydrolysis extract flow.

20. The reactor of claim 15, characterized in that the reactor (10) operates flooded until it at least the upper hydrolysis extract captation is covered (11).

* * * * *